US009266247B1

(12) United States Patent
Coulon

(10) Patent No.: US 9,266,247 B1
(45) Date of Patent: Feb. 23, 2016

(54) DEVICE FOR LAYERING FOODS AND CUTTING INTO PORTIONS

(71) Applicant: Remi Paul Coulon, Fort Lauderdale, FL (US)

(72) Inventor: Remi Paul Coulon, Fort Lauderdale, FL (US)

( * ) Notice: Subject to any disclaimer, the term of this patent is extended or adjusted under 35 U.S.C. 154(b) by 155 days.

(21) Appl. No.: 13/653,562

(22) Filed: Oct. 17, 2012

(51) Int. Cl.
*B26B 29/06* (2006.01)

(52) U.S. Cl.
CPC ..... *B26B 29/063* (2013.01); *Y10T 83/695* (2015.04); *Y10T 83/75* (2015.04)

(58) Field of Classification Search
CPC ..... B26B 29/063; B26D 7/01; Y10T 83/75; Y10T 83/695
USPC ..... 83/762, 454, 870, 932; 30/289, 290, 30/291.1, 298.4, 124; 100/98 R; 269/87.2, 269/295
See application file for complete search history.

(56) References Cited

U.S. PATENT DOCUMENTS

| | | | | | |
|---|---|---|---|---|---|
| 731,919 | A * | 6/1903 | Larson | 83/762 |
| 1,462,717 | A * | 7/1923 | Maus | 269/13 |
| 3,318,352 | A * | 5/1967 | Seltzer | 269/288 |
| 3,452,795 | A * | 7/1969 | Davies | 83/762 |
| 3,811,356 | A * | 5/1974 | Wyler | 83/762 |
| 4,085,642 | A * | 4/1978 | Birmingham | 83/764 |
| 5,440,959 | A * | 8/1995 | Bindon et al. | 83/100 |
| 2011/0232441 | A1* | 9/2011 | Aguirre | 83/35 |
| 2013/0025421 | A1* | 1/2013 | Trimarchi et al. | 83/30 |

* cited by examiner

*Primary Examiner* — Laura M Lee
(74) *Attorney, Agent, or Firm* — Malin Haley DiMaggio & Bowen, P.A.

(57) ABSTRACT

A device for layering and cutting food, comprising a main body having an elongated bottom wall and two opposing parallel side walls extending upward from said bottom wall, the side walls and the bottom wall defining a rectangular food receiving receptacle. Each of the side walls include a plurality of vertically disposed wall slots. The body receptacle is configured to receive food and the wall slots are configured to receive a cutting implement to cut food into one or more portions. A removable food supporting plate is disposed in the body receptacle and on the bottom wall of the main body. The food is received on the removable plate and the removable plate is adapted to be removed with food from the receptacle of said main body after cutting the food into one or more portions. The removable plate includes grooves wherein the wall slots of the opposing side walls align and the plate grooves of the base align with the slots.

1 Claim, 7 Drawing Sheets

DEVICE FOR LAYERING FOODS AND CUTTING INTO PORTIONS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to kitchen and cooking devices and more particularly to a useful device for layering foods and cutting portions thereof.

2. Description of Related Art

In many entertaining settings, it is desirable to provide pre-portioned or generally smaller sized food items when serving appetizers, entrees, and/or desserts. In a typical situation, a chef would not prepare each individual item separately but rather would prepare a large portion of a given dish, such as a lasagna or cake, and then selectively slice or cut the dish into the desired portions for serving. Often times the large portion is cut or sliced within the dish that it was originally baked or cooked. The cutting or slicing operation is prone to disadvantages, however, such as unequal portion sizes and damaged or unpleasing visible edges and the loss of usable portions. Furthermore, it is often difficult to prepare large portions of layered items such as lasagnas and cakes because the overly large baking dishes and pans do not provide adequate containment. This again can lead to a visually unappealing final product, uneven application of ingredients, uneven portions, and loss of usable portions. Furthermore, when needing large quantities of food, cooking same in an oversized dish can lead to uneven cooking—portions of the food remain undercooked while other portions are overcooked. Accordingly, there is a need in the art for an easy to use device for layering and apportioning food items.

It is, therefore, to the effective resolution of the aforementioned problems and shortcomings of the prior art that the present invention is directed. However, in view of the kitchen and cooking devices in existence at the time of the present invention, it was not obvious to those persons of ordinary skill in the pertinent art as to how the identified needs could be fulfilled in an advantageous manner.

SUMMARY OF THE INVENTION

A device for layering and cutting food, comprising: a main food receiving body having an elongated floor or bottom wall and two opposing parallel side walls extending upward from a bottom wall, the side walls and the bottom wall defining an elongated rectangular receptacle for receiving food. Each of the side walls include a plurality of vertically disposed parallel slots. The body receptacle is configured to receive food and the wall slots are configured to receive a cutting implement to cut said food into one or more portions. In some embodiments, the device includes a removable food supporting plate configured to be disposed in the body receptacle and on the bottom wall of the main body, wherein the food is received on the removable plate. The removable plate can be removed from the receptacle of said main body after cutting the food into one or more portions for transfer to a serving dish or for serving from the plate. In some embodiments, the removable plate includes one or more lateral grooves disposed across a width wherein the slots of said opposing side walls align with one another and the grooves of the plate align with the slots.

Further included is a food tamper base comprising an elongated thin flat body. The tamper base is peripherally configured to fit and to be received during food preparation horizontally in the receptacle of said main body to manually layer and compress the food layered therein. The tamper base is further configured to snap-fit to the removable plate during storage, wherein the bottom wall of the main body is disposed between the tamper base and the removable plate during storage. A spreader/slicer is provided and is configured to be received in said opposing wall slots during the cutting/portioning process. In some embodiments, the spreader/slicer can be removably stored in the tamper base.

Accordingly, it is an object of the present invention to provide a device for layering and cutting foods into portion in a simple, clean and effective manner.

In accordance with these and other objects which will become apparent hereinafter, the instant invention will now be described with particular reference to the accompanying drawings.

DETAILED DESCRIPTION

Figure 1:
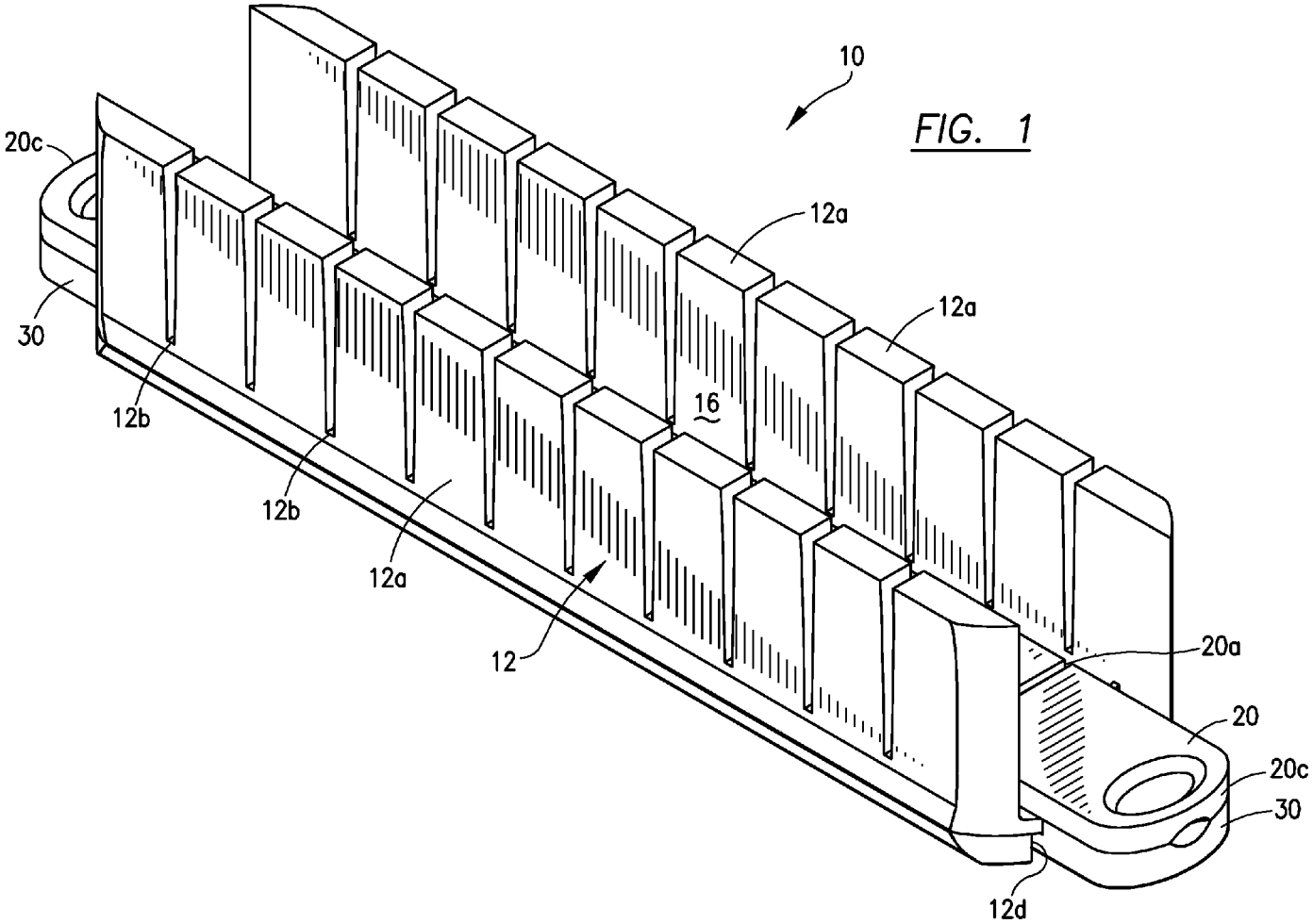
FIG. 1 is a front perspective view of one embodiment of the present invention shown in an assembled state.
Figure 2:
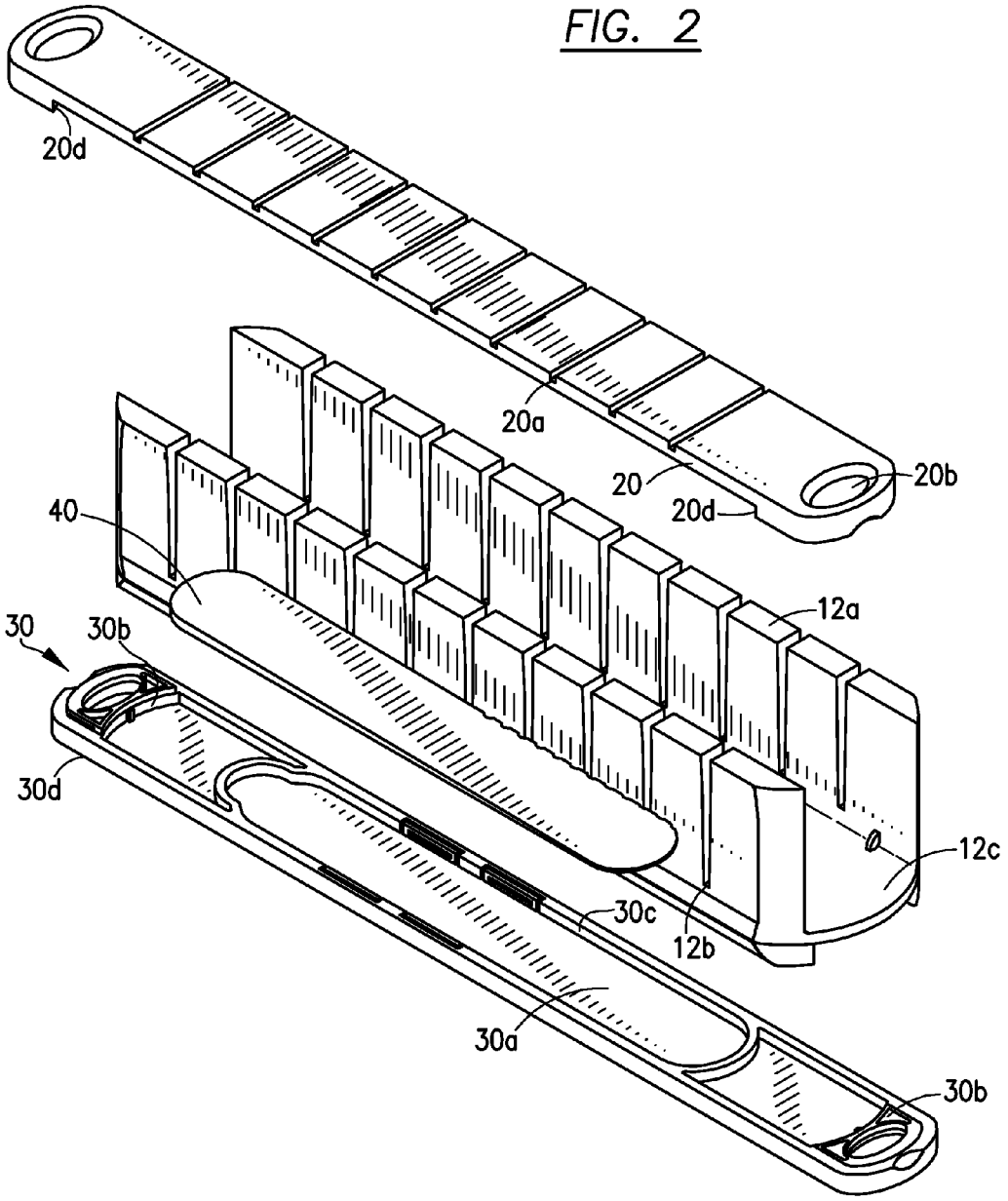
FIG. 2 is front perspective view of one embodiment of the present invention shown in an exploded view, disassembled.
Figure 3:
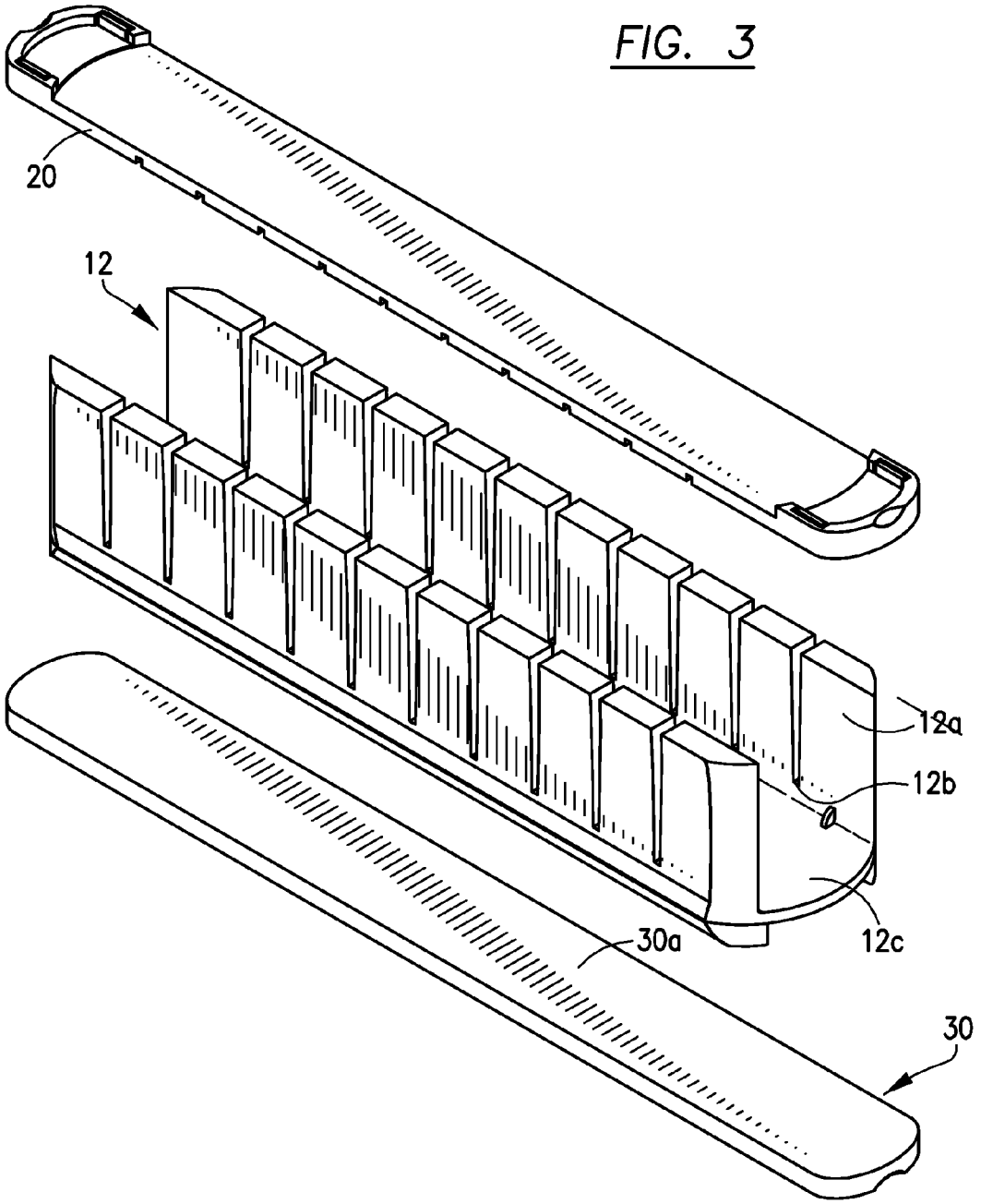
FIG. 3 is an exploded perspective view of the device with the components separated.

With reference to FIGS. 1-3, shown is one embodiment of the device 10 of the present invention having a main food receptacle or receiving body 12, a removable food supporting plate 20, a tamper base 30, and a spreader/slicer 40. (FIG. 2) The main body 12 comprises a generally elongated rectangular body having two opposing side walls 12*a* extending upward from the bottom wall 12*c*. In some embodiments, the first and second ends of the main body 10 are open. The parallel walls 12*a* define an elongated inner receptacle 16 which receives food product as further described below. The main body side walls 12*a* each include a plurality of vertically disposed slots 12*b* along the length thereof. In some embodiments, the slots 12*b* of each of walls 12*a* are aligned laterally with one another and are adapted to cohesively and removably receive a cutting implement such as spreader/slicer 40 (FIG. 2). as further described. In some embodiments, the main body wall slots 12*b* extend partially down the side walls 12*a* and need not reach all the way to the bottom wall 12*c*. It is desirable for the wall slots 12*b* to be evenly spaced along side walls 12*a* in order to provide even sized food portions as described below. The main body 12 also includes an underside recessed channel 12*d* which is configured to receive removable tamper base 30 as further described below.

Removable food supporting plate 20 comprises an elongated body generally matching the geometry of the bottom wall 12*c* of the main body 12. Removable food supporting plate 20 is configured to be removably received within receptacle 16 of main body 12 such that the plate 20 rests at the bottom thereof, on top of bottom wall 12*c*. Removable plate 20 includes a plurality of laterally disposed grooves 20*a* along the width of the upper surface of plate 20. The grooves 20*a* are configured to align with the slots 12*b* of the main food receiving body 12 to further assist with receiving a food cutting implement such as spreader/slicer 40. In some embodiments, the ends 20*c* of the removable food support plate 20 extend somewhat downward defining an elongated notch 20*d* along the bottom of the base 20. Thus, as is shown in FIG. 2, the removable plate 20 fits within main body 10 such that the elongated notch 20*d* is received over bottom wall 12*c* of the main body 10 while the ends 20*c* of the plate 20 extend over the ends of the main body 12. Thus, the main body ends help keep the plate 20 retained on the bottom wall 12*c*. The ends also define recesses 20*b* which provide a space for the user to grasp the removable plate 20 as further described below. Accordingly, as shown in FIG. 2, the ends of the base 20 extend beyond the first and second ends of the main body 12.

Also provided in some embodiments is a food tamper base 30 which comprises an elongated member generally matching the geometry of the removable plate 20. FIGS. 1-4 depict one embodiment of the food tamper base 30. The topside 30*a* and 30*b* of tamper base 30 comprises structure useful for storing the various components of the present invention. In some embodiments, tamper base 30 includes a recess 30*a* delimited by raised edges 30*c* which are useful for retaining the spreader/slicer 40 during storage. The underside 30*d* of tamper base 30 comprises a generally flat planar surface useful as a tool for pressing down layers of food placed in receptacle 16 of the main body.

With reference to FIG. 1 during storage, the device 10 is in the storage mode. The tamper base 30 is placed underneath main body 10 as a base such that the tamper base 30 is received in underside main body longitudinal channel 12*d* thereof. The ends of the tamper base 30 include snap protrusions 30*b* which are configured to engage the ends 20*d* of the plate 20 during use and storage (FIG. 2). With the tamper base 30 underneath main body 10, the removable plate 20 is stored into the main body 12 and onto the bottom wall 12*c* of the main body 12. The ends of the plate 20 are configured to removeably snap-fit onto the protrusions 30*b* on either end of the tamper base 30. Accordingly, the plate 20 and tamper base 30 are secured to the main body 12, with the bottom wall 12*c* disposed between the plate 20 and tamper base 30.

Prior to use, the food support plate 20 may be disengaged from the tamper base 30 and the tamper base 30 may be removed away from main body 12 for use in manually tamping or pressing down food as further described in FIGS. 5-9. In operation, the removable plate 20 is placed inside the receptacle 16 of the main body 12 in lengthwise fashion and is secured onto the bottom wall 12*c*. Food product is then placed inside the receptacle 16 of the main body 12, on top of removable plate 20 as desired. Food can be layered as desired, lasagna is an example. Food ingredients may be added until the main body receptacle 16 is filled to the top periphery of the side walls 12*a*. The user may utilize a spreader such as spreader/slicer 40 to assist with layering various ingredients such as sauces, fillings, and frosting. The tamper base 30 is also used to press or tamp down layers of food ingredients as desired.

Once the preparation of the ingredients has been completed, the user can utilize a cutting implement such as spreader/slicer 40 or a traditional knife and insert same into main body wall slots 12*b* in successive fashion in order to cut one or more portions of the layered food. It is appreciated that the cutting implement 40 be inserted toward the top of the food product and be brought down and into the wall slots 17 until the cutting implement is stopped by the lower portion of the side walls 12*a* and/or the top surface of the removable plate 20. It is appreciated that the user can vary the portion size by skipping one or more wall slots 12*b* along the length of the device. In the case where wall slots 12*b* are evenly spaced, the user can prepare as many evenly sized food portions as desired.

Once the cutting or slicing has been completed as desired, the removable plate 20 can be removed from the main body 12 with the sliced food pieces resting on the plate 20. This can be accomplished by using grasping recesses 20*d* on the plate 20 to snap the plate 20 away from the main body 12, and then removing the plate 20 (with food) by either sliding it laterally away from the main body 12 or by lifting plate 20 upward out of the receptacle 16 of the main body 12.

Figure 5:
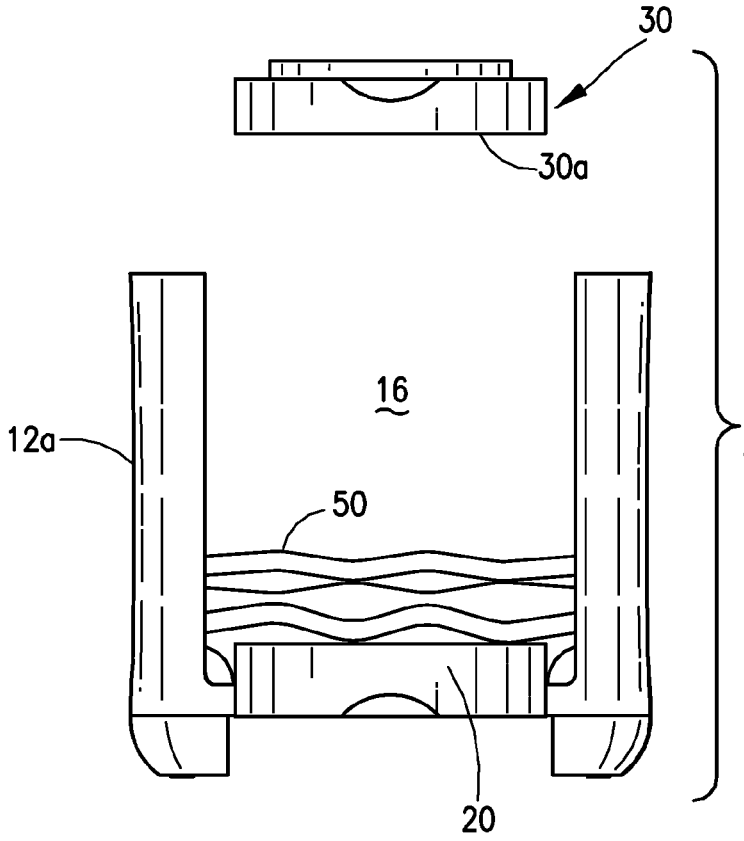
FIG. 5 is an end elevational view of the device with food stuffs.
Figure 6:
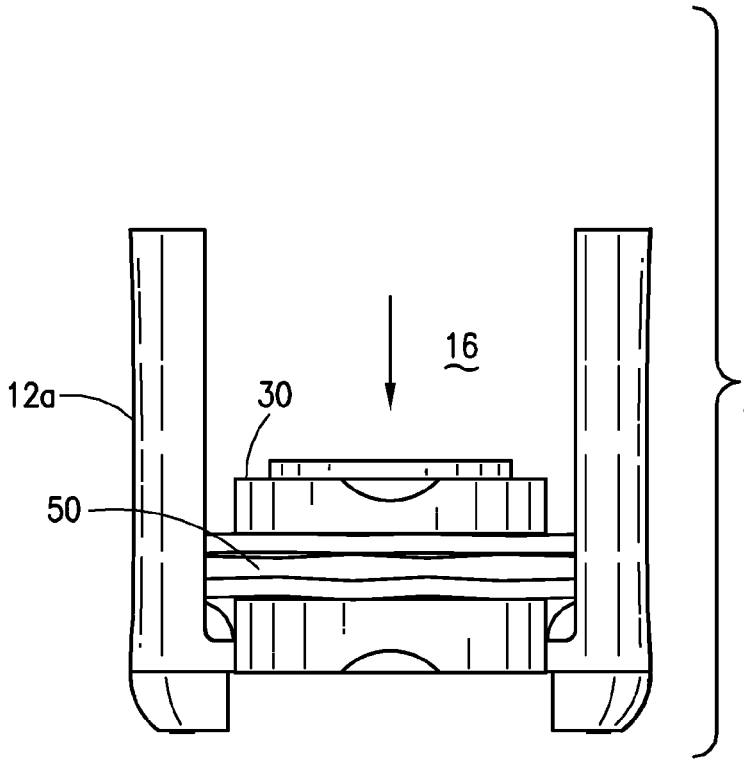
FIG. 6 is an end elevational view of the device with food stuffs covered by the tamper base.
Figure 7:
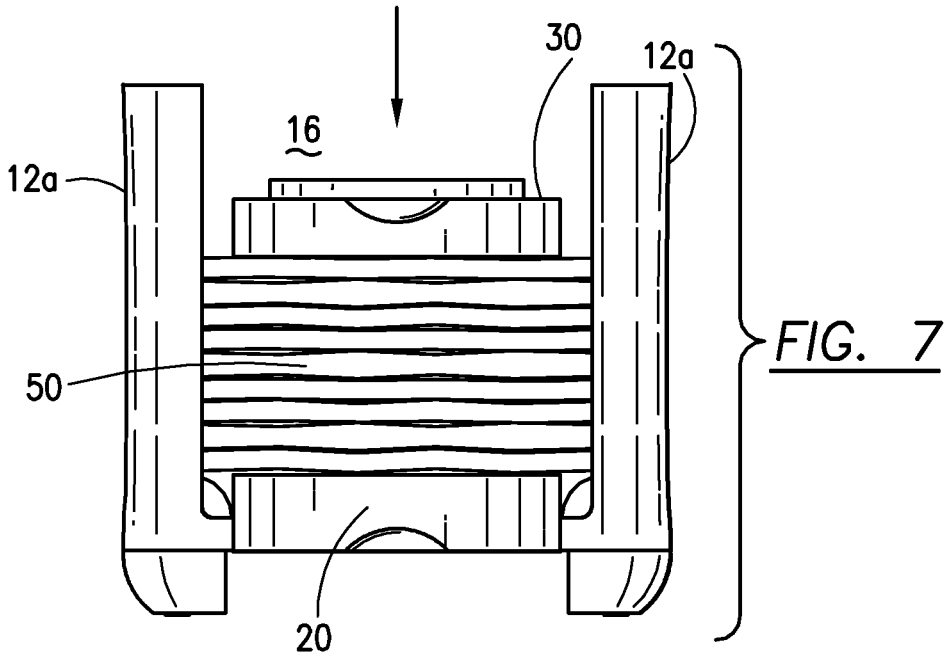
FIG. 7 is an end elevatational view of the device with additional layers of food covered by the tamper base.
Figure 8:
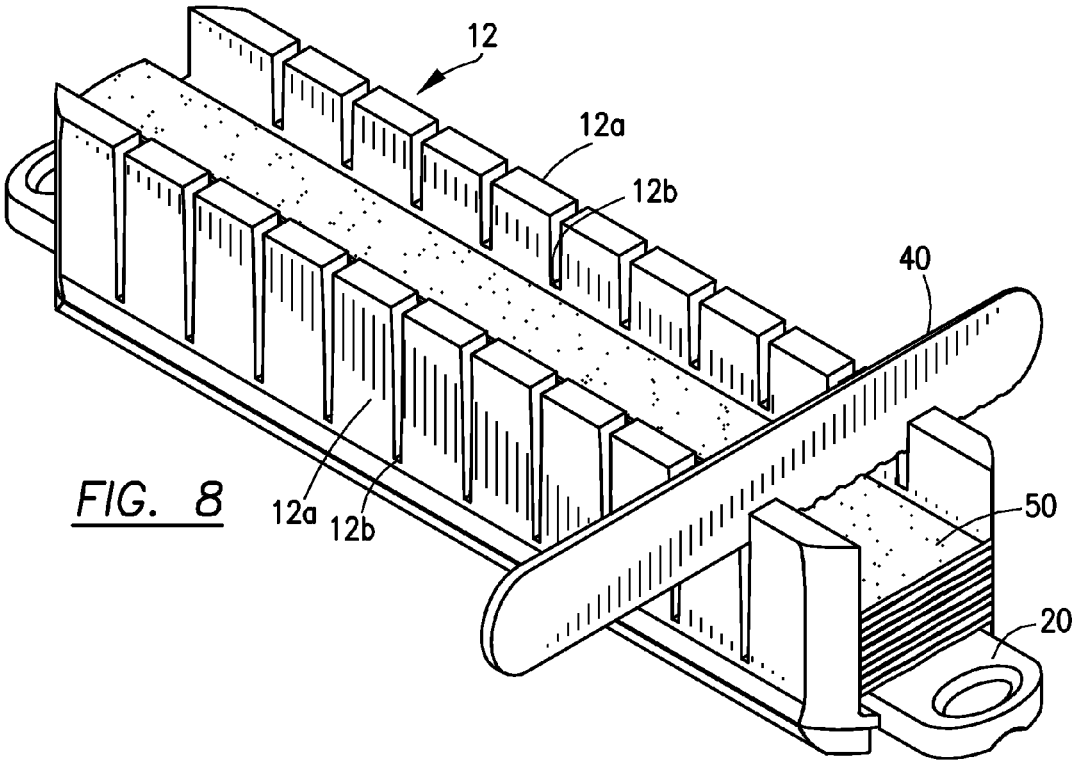
FIG. 8 is a perspective view of the device with food and the slicer arranged for cutting the food.
Figure 9:
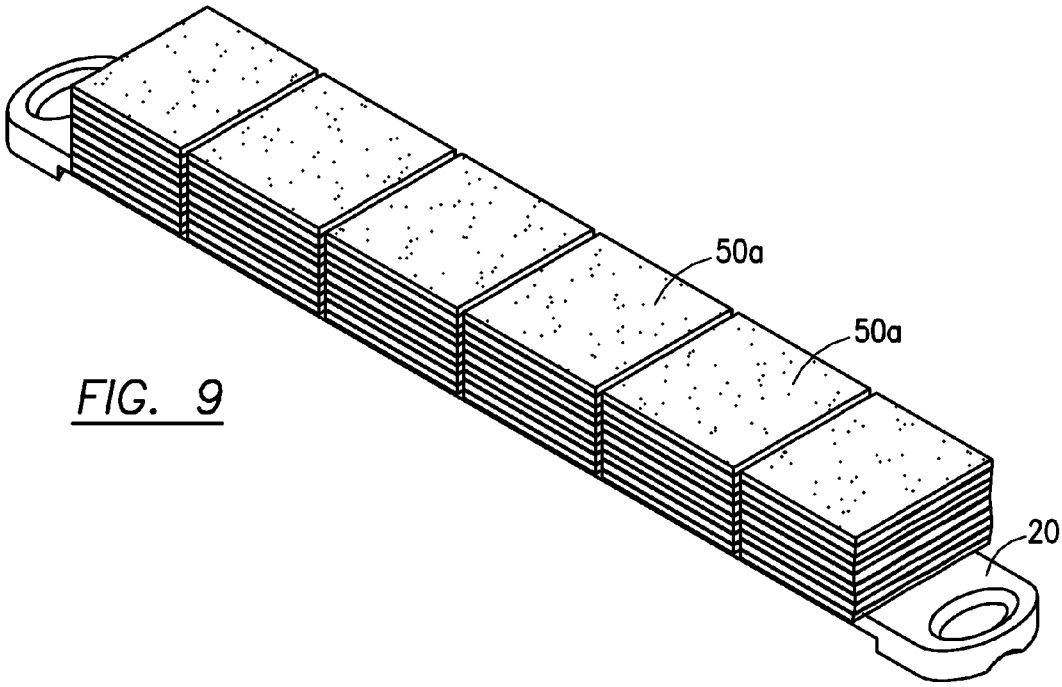
FIG. 9 is a perspective view of the food tray removable plate removed from the receptacle with food after the food has been sliced.

At this point, the now sliced portions of food can be removed from the plate 20 for cooking, baking, and/or serving. The slicing and removal procedure is depicted in FIGS. 5-9. FIG. 5 is an end elevated view of the device with food stuffs. FIG. 6 is and end elevated view of the device with food stuffs covered by the base tamper plate. FIG. 7 is an end elevated view of the device with additional layers of food covered by the tamper base 30. FIG. 8 is a perspective view of the main body 12 with food and the slicer 40 arranged for cutting the food. FIG. 9 is a perspective view of the food tray removed from the housing with food after the food pieces 50*a* has been sliced. FIGS. 5 and 6 show layered food 50 in main body chamber 16 positioned on said removable plate 20. Tamper base 30 is used to compress food 50 downwardly in FIG. 6 as shown by the arrow. In FIG. 7 the food 50 has added layers until the main body chamber 16 is filled. FIG. 8 shows main body 12 filled with food 50 ready to be cut into segments of pieces by slicer 40. FIG. 9 shows removable plate 20 having been removed from the main body 12 in FIG. 8 after cutting into pieces of food 50*a*.

Figure 4:
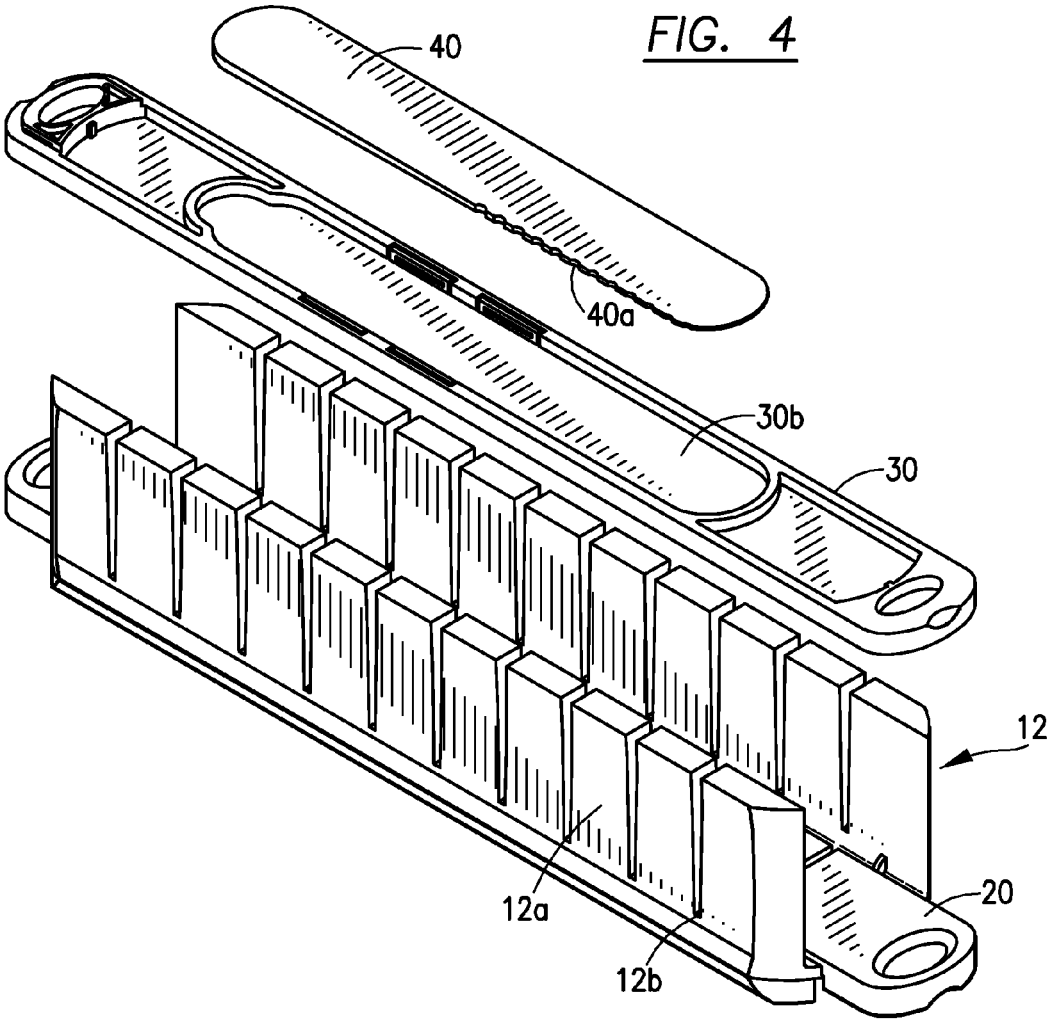
FIG. 4 is an exploded perspective view of the device with the tamper base, and slicer separated, and the removable plate mounted in the bottom of the food receptacle body.

It is appreciated that the present invention can comprise a variety of durable materials such as plastics, resins, metals, and combinations thereof. In some embodiments, however, it is desirable for the constituent components of the present invention to comprise a washable and/or dishwasher-safe material that can withstand moisture and heat. It is further appreciated that spread/slicer 40 can be provided as an additional component of the present invention to be used in preparing food within the device as well as carrying out cutting and slicing operations. To that end, at least a portion of the spread/slicer 40 may include a serrated edge 40 *a* (FIG. 4). Traditional knives and other cutting implements are equally suitable and effective, however. Further, it is appreciated that the size and shape of the main body 12 and the other components of the present invention can vary depending on the desired size and shape of the food product utilized with the invention. For example, the depicted embodiment results in square shaped or rectangle shaped portions; however the side walls 12*a* can vary in shape and size to accommodate final products of other desired shapes, for example such final products having curved or wavy edges. It is further appreciated that a simpler embodiment of the present invention comprises the main body without the removable tamper base or removable food support plate.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A device for layering and cutting food, comprising:

a main body for receiving layers of food;

said main body having an elongated bottom wall and two opposing parallel side walls extending upward from said bottom wall, said side walls and said bottom wall defining a food receiving receptacle;

each of said side walls including a plurality of vertically disposed parallel slots;

a removable food supporting plate removably received within said main body receptacle such that said plate rests at the bottom of said receptacle and on top of said bottom wall of said main body;

said food receiving receptacle being configured to receive said food on said removable plate;

a food tamper base comprising an elongated body configured to be received horizontally in said receptacle of said main body to layer and apply said food therein;

wherein said tamper base and said removable plate have matching geometry such that said tamper base is configured to snap-fit with said removable plate during storage, wherein said bottom wall of said main body is disposed between said tamper base and said removable plate;

a spreader/slicer is configured to removably engage said tamper base during storage, said spreader/slicer removably received in a recess of said tamper base, said recess delimited by raised edges that retain that spread slicer;

said main body wall slots being configured to receive a cutting implement to cut said food into one or more portions; and wherein said removable plate is adapted to be removed from said receptacle of said main body after cutting said food into one or more portions.

* * * * *